US010677023B2

(12) United States Patent
Rice

(10) Patent No.: US 10,677,023 B2
(45) Date of Patent: Jun. 9, 2020

(54) LINER HANGER ASSEMBLY HAVING RUNNING TOOL WITH EXPANDABLE MEMBER AND METHOD

(71) Applicant: James Kevin Rice, Houston, TX (US)

(72) Inventor: James Kevin Rice, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 139 days.

(21) Appl. No.: 15/622,344

(22) Filed: Jun. 14, 2017

(65) Prior Publication Data

US 2018/0363428 A1 Dec. 20, 2018

(51) Int. Cl.
*E21B 43/10* (2006.01)
*E21B 23/00* (2006.01)

(52) U.S. Cl.
CPC ..... *E21B 43/10* (2013.01); *E21B 23/00* (2013.01)

(58) Field of Classification Search
CPC ..... E21B 43/10; E21B 43/103; E21B 23/01; E21B 29/00; E21B 23/06; E21B 33/12
See application file for complete search history.

(56) References Cited

U.S. PATENT DOCUMENTS 2,144,026 A * 1/1939 Park ..... E21B 33/1208 277/340
3,087,549 A * 4/1963 Brunton ..... E21B 29/02 166/100
3,608,632 A * 9/1971 Solum ..... E21B 23/01 166/124
7,520,335 B2 * 4/2009 Richard ..... E21B 43/103 166/207
2002/0056553 A1 5/2002 Duhon et al.
2003/0047320 A1 * 3/2003 Badrak ..... E21B 23/00 166/380
2006/0272827 A1 12/2006 Adam et al.
2008/0093086 A1 * 4/2008 Courville ..... E21B 19/22 166/378
2009/0071661 A1 3/2009 Ring
2009/0211770 A1 8/2009 Nutley et al.
2010/0138158 A1 * 6/2010 Nutley ..... E21B 33/1208 702/6
2013/0140022 A1 * 6/2013 Leighton ..... E21B 29/10 166/277
2013/0146308 A1 * 6/2013 Saltel ..... E21B 23/01 166/382
2014/0054047 A1 2/2014 Zhou
(Continued)

OTHER PUBLICATIONS

"Bakerline Series Completion Portfolio"; Baker Hughes, 2014, 80 Pages.

(Continued)

*Primary Examiner* — Robert E Fuller
*Assistant Examiner* — Theodore N Yao
(74) *Attorney, Agent, or Firm* — Cantor Colburn LLP

(57) ABSTRACT

A downhole system having a liner hanger assembly includes a liner hanger and a running tool. The running tool includes a tubular and an expandable member disposed circumferentially around the tubular. The expandable member is configured to increase in volume from a first condition to a second condition at a surface location. The second condition of the expandable member connects the running tool to the liner hanger.

16 Claims, 6 Drawing Sheets

(56) References Cited

U.S. PATENT DOCUMENTS

| | | | | |
|---|---|---|---|---|
| 2014/0116678 | A1* | 5/2014 | Broussard | E21B 33/1208 166/206 |
| 2016/0138369 | A1* | 5/2016 | Tunget | E21B 37/02 166/311 |
| 2018/0305996 | A1* | 10/2018 | Duan | E21B 33/12 |

OTHER PUBLICATIONS

"REPacker system provided long-term solution to formation crumbling", Baker Hughes, 2012, 2 pages.
International Search Report for International Application No. PCT/US2018/031934; dated Aug. 21, 2018; 5 pages.
Written Opinion of the International Search Report for International Application No. PCT/US2018/031934; dated Aug. 21, 2018; 8 pages.

* cited by examiner

LINER HANGER ASSEMBLY HAVING RUNNING TOOL WITH EXPANDABLE MEMBER AND METHOD

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration.

When a liner string is run through casing in the borehole, the liner string can be supported within the casing by a liner hanger. Running the liner hanger and depending liner string into the borehole is accomplished using a running tool rated for the weight of the liner hanger and liner string. Running tools include complex mechanical features and a number of moving parts to ensure connection with the liner hanger, as well as provide for subsequent release. After the running tool is utilized in a run-in operation for the liner hanger, the running tool is brought back to surface and redressed for subsequent operations.

The art would be receptive to alternatives and improvements in downhole systems including liner hanger assemblies and methods.

SUMMARY

A downhole system having a liner hanger assembly includes a liner hanger and a running tool. The running tool includes a tubular and an expandable member disposed circumferentially around the tubular. The expandable member is configured to increase in volume from a first condition to a second condition at a surface location. The second condition of the expandable member connects the running tool to the liner hanger.

A method of assembling a liner hanger assembly, the method including: disposing an expandable member in a first condition circumferentially around a tubular; arranging the tubular and expandable member within a liner hanger at a surface location; and, expanding the expandable member to have a second condition and to connect the tubular to the liner hanger at the surface location.

A method of operating a liner hanger assembly having a running tool and a liner hanger, the method including: running the liner hanger downhole using the running tool, the running tool connected to the linger hanger by an expandable member, the expandable member having an increase in volume from a first condition to a second condition at a surface location prior to running the liner hanger downhole; and, setting the liner hanger within an outer tubular at a downhole location; wherein the running tool is configured to carry a weight of the liner hanger using the expandable member during run-in.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
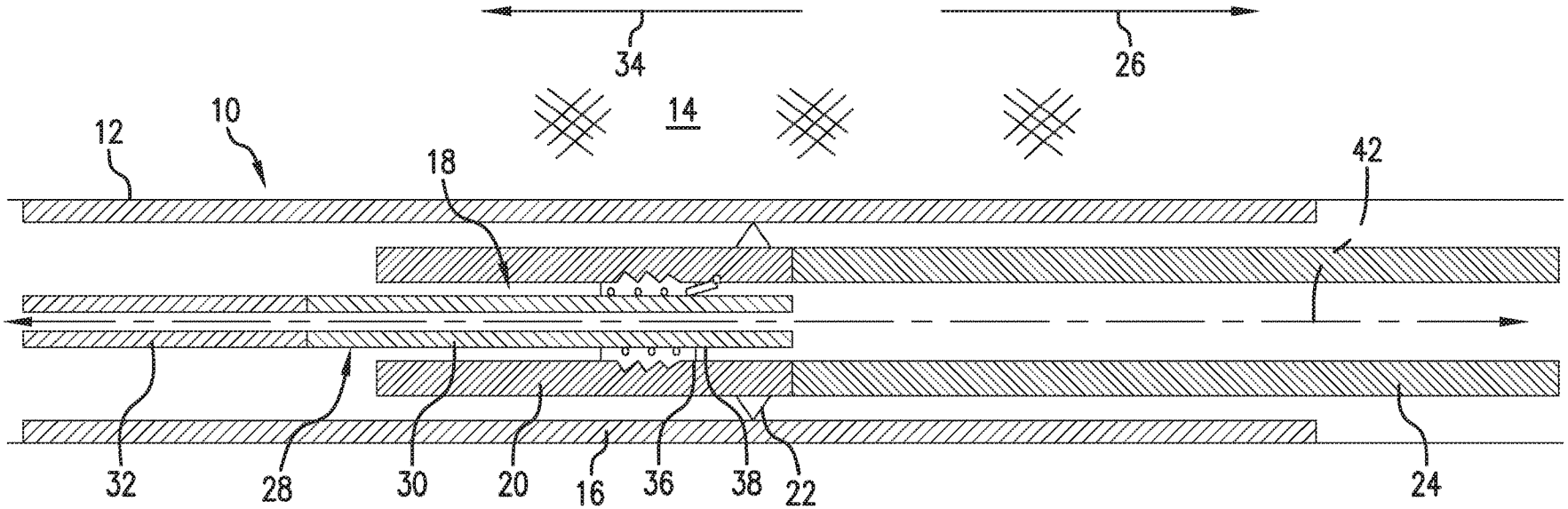
FIG. 1 depicts a schematic side sectional view of an embodiment of a downhole system including an embodiment of a liner hanger assembly having a running tool.

Referring to FIG. 1, a downhole system 10 is employed within a borehole 12 extending through a formation 14 from a surface location. The borehole 12 may be lined with a casing 16. The downhole system 10 includes a liner hanger assembly 18 having a longitudinal axis 42. The liner hanger assembly 18 includes a liner hanger 20. The liner hanger 20 may include one or more setting devices 22, such as, but not limited to slips, to set the liner hanger 20 within the casing 16 when the liner hanger 20 reaches a desired location. Alternatively, the liner hanger 20 may be set directly within the borehole 12 instead of casing 16. Liner string 24 is connected to a downhole end of the liner hanger 20. The liner string 24 may include any number of pipes, interconnections and tools that can be hung from the liner hanger 20.

For running the liner hanger 20 and liner string 24 in the downhole direction 26, the liner hanger assembly 18 further includes a running tool 28. The running tool 28 includes a tubular 30. The tubular 30 could be any pipe, drill pipe, tubular, or mandrel capable of carrying the weight of the liner hanger 20 and liner string 24. One or more additional sections of tubular 32 may be connected to an uphole end of the tubular 30 and extend in an uphole direction 34 to a surface location. The running tool 28 further includes an expandable member 36 circumferentially disposed around and, in the illustrated embodiments, upon an exterior surface 38 of the tubular 30. To dispose the expandable member 36 on the tubular 30, the expandable member 36 may be, but is not limited to, wrapped, bonded, or slid onto the tubular 30.

The expandable member 36, in the expanded condition shown in FIG. 1, serves to connect the running tool 28 to the liner hanger 20.

Figure 3:
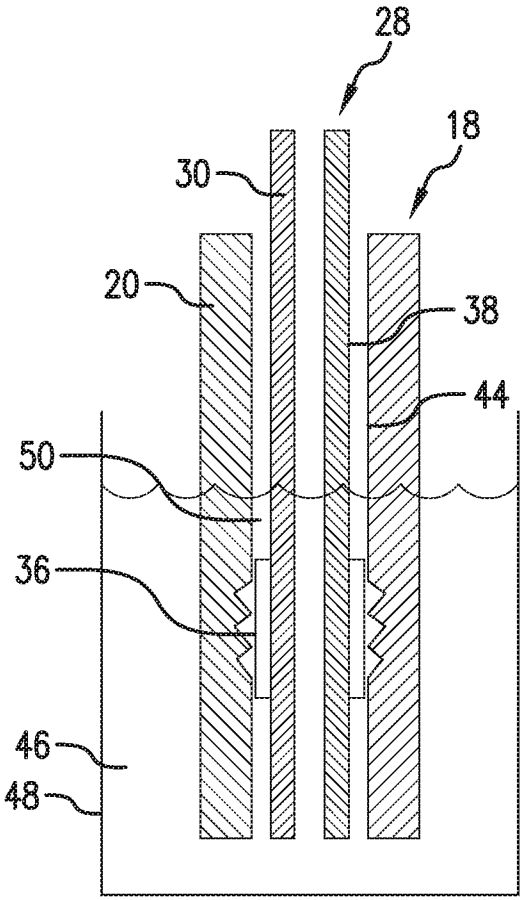
FIG. 3 depicts a schematic side sectional view of the portion of the liner hanger assembly of FIG. 2 in one embodiment of a method of assembling the liner hanger assembly.
Figure 2:
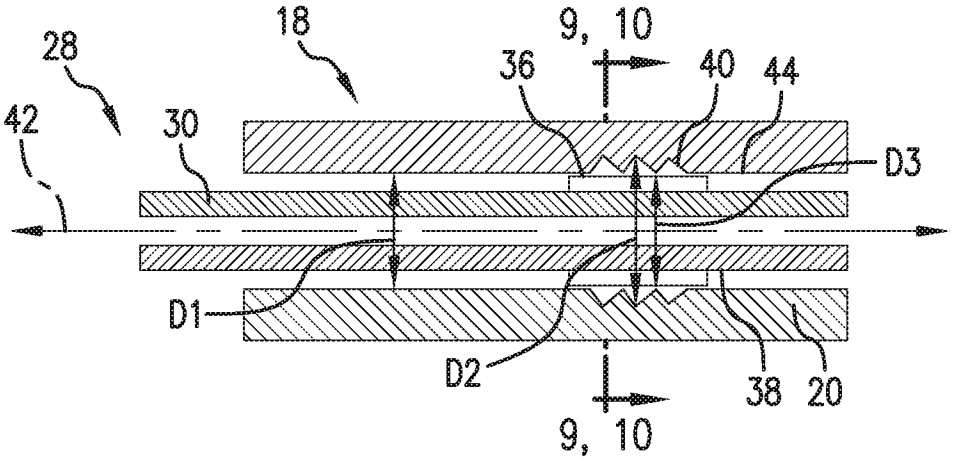
FIG. 2 depicts a schematic side sectional view of a portion of the liner hanger assembly of FIG. 1 in a first condition.
Figure 4:
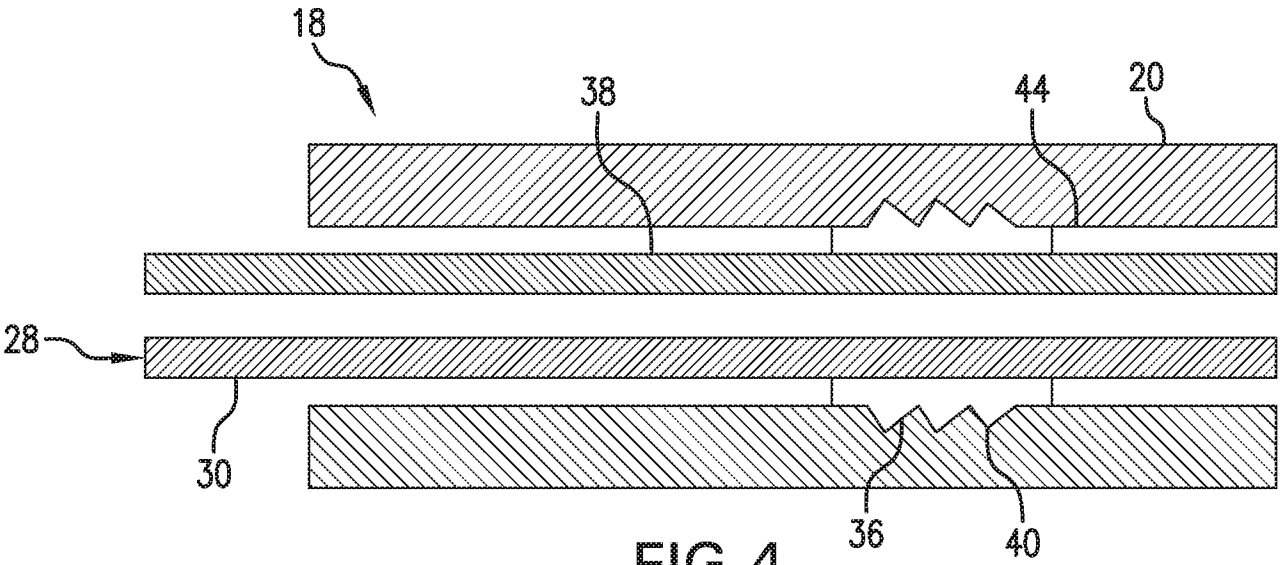
FIG. 4 depicts a schematic side sectional view of the portion of the liner hanger assembly of FIG. 1 in a second condition.

With further reference to FIGS. 2-4, one embodiment of a method of assembling the liner hanger assembly 18 is shown. The method of assembling the liner hanger assembly 18 occurs at a surface location rather than in a downhole environment of the borehole 12 (FIG. 1). The surface location could include, but is not limited to, a facility of a manufacturer, a customer warehouse, and on a job site. FIG. 2 illustrates the running tool 28 and the expandable member 36 in a first condition, where the running tool 28 is disposed interiorly of the liner hanger 20, but the expandable member 36 has not yet been expanded, and therefore the running tool 28 and the liner hanger 20 are not yet connected.

After the running tool 28 and expandable member 36 are located interiorly of the liner hanger 20, the expandable member 36 can then be expanded to the second condition. Here, the second condition indicates a condition where the expandable member 36 is expanded and the running tool 28 is connected to the liner hanger 20. The second condition is thus a run-in condition of the liner hanger assembly 18. With reference to FIG. 3, when the expandable member 36 includes a swellable material, one embodiment of expanding the expandable member 36 from the first condition to the second condition may include dipping the expandable member 36 within an activator fluid 46, such as by placing the running tool 28 and liner hanger 20 in a tub 48 containing the activator fluid 46 to immerse the expandable member 36 within the activator fluid 46, which will cause the expandable member 36 to expand to the second condition shown in FIG. 4. The activator fluid 46 will come in contact with the expandable member 36 through the annulus 50 between the exterior surface 38 of tubular 30 and interior surface 44 of liner hanger 20. An alignment structure (not shown) may be provided to hold the tubular 30 in place with respect to the liner hanger 20 while the expandable member 36 is expanding. Other methods of exposing the expandable member 36 to the activator fluid 46 may include pouring, spraying, or otherwise introducing the activator fluid 46 through the annulus 50.

In some embodiments of assembling the liner hanger assembly 18, after the tubular 30 is secured to the liner hanger 20 using the expandable member 36, the tubular 32 (FIG. 1) may be connected to tubular 30 and the liner string 24 (FIG. 1) may be connected to liner hanger 20. Alternatively, the tubular 32 and liner string 24 may be connected to the tubular 30 and liner hanger 20, respectively, prior to expansion of the expandable member 36.

In the illustrated embodiment of FIGS. 2-4, in both the first and second conditions, an inner diameter of the expandable member 36 may be in contact with the exterior surface 38 of the tubular 30. In the first condition, the outer diameter of the expandable member 36 has a first outer dimension that does not contact the interior surface 44 of the liner hanger 20. Thus, the running tool 28 with expandable member 36 can be moved longitudinally with respect to the liner hanger 20 in the first condition. However in the second condition, in the illustrated embodiments, the outer diameter of the expandable member 36 has a second outer dimension and contacts the interior surface 44. The outer diameter of the expandable member 36 in the second condition is greater than the outer diameter of the expandable member 36 in the first condition in the illustrated embodiments. Further, in any of the above-described embodiments, the volume of the expandable member 36 in the second condition is greater than the volume of the expandable member 36 in the first condition.

Figure 6:
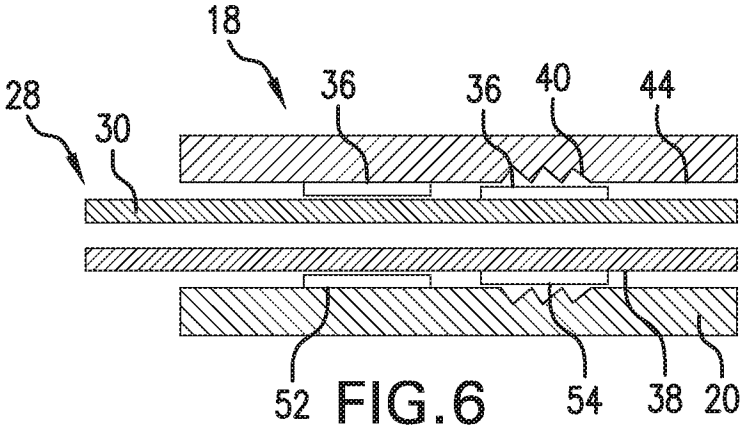
FIG. 6 depicts a schematic side sectional view of another alternate embodiment of a portion of the liner hanger assembly of FIG. 1 in the first condition.
Figure 5:
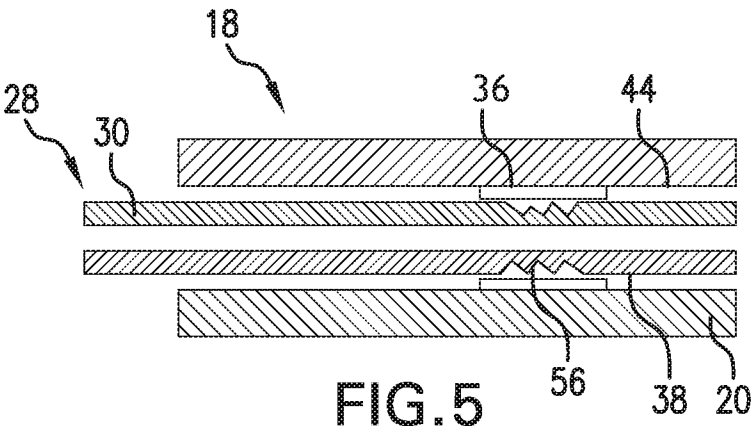
FIG. 5 depicts a schematic side sectional view of an alternate embodiment of a portion of the liner hanger assembly of FIG. 1 in the first condition.
Figure 8:
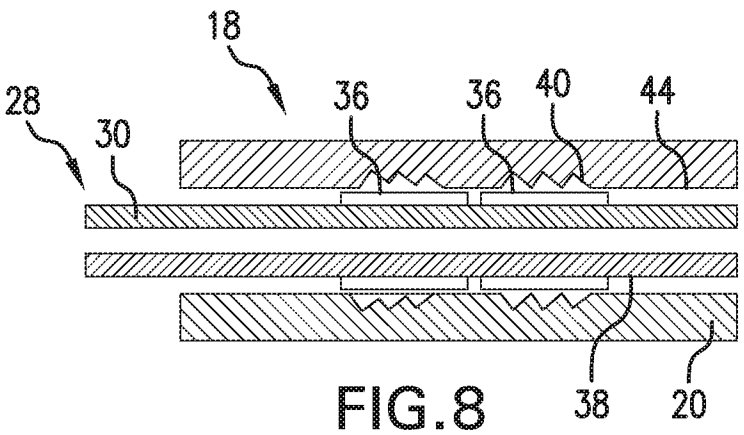
FIG. 8 depicts a schematic side sectional view of yet another alternate embodiment of a portion of the liner hanger assembly of FIG. 1 in the first condition.
Figure 7:
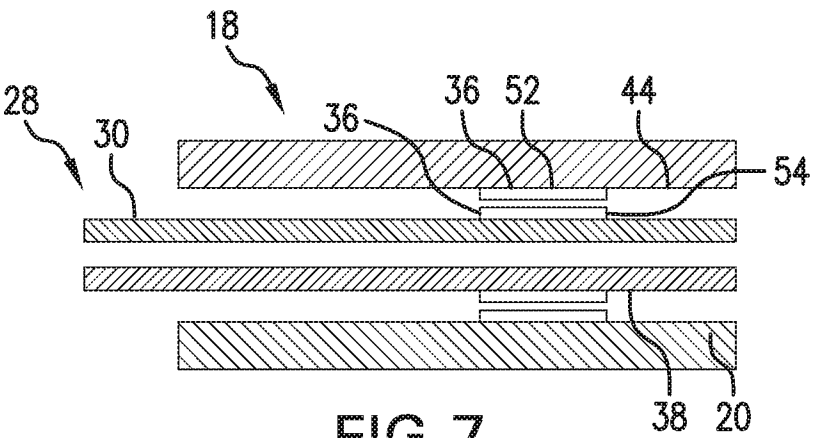
FIG. 7 depicts a schematic side sectional view of still another alternate embodiment of a portion of the liner hanger assembly of FIG. 1 in the first condition.

When the tubular 30 is not yet arranged within the liner hanger 20, the exterior surface 38 of the tubular 30 is generally easier to access and work upon than the interior surface 44 of the liner hanger 20 with respect to disposing the expandable member 36 thereon. However, in an alternate embodiment of the first condition, as schematically depicted in FIG. 5, the expandable member 36 is attached to the interior surface 44 of the liner hanger 20 instead of the exterior surface 38 of tubular 30. In still other alternate embodiments schematically depicted in FIGS. 6 and 7, a first section 52 of the expandable member 36 is attached to the interior surface 44 of the liner hanger 20 and a second section 54 of the expandable member 36 is attached to the exterior surface 38 of the tubular 30. In such an embodiment, the sections of the expandable member 36 may be disposed at either longitudinally discrete locations as shown in FIG. 6, or at overlapping locations as shown in FIG. 7. Further, in any of the above-described embodiments, one or more expandable members 36 may be employed. FIG. 8 schematically depicts one embodiment that employs multiple expandable members 36. This embodiment could also be combined with any of the other above-described embodiments, such as multiple expandable members 36 disposed on the interior surface 44 of the liner hanger 20, or one or more expandable members 36 disposed on both the interior surface 44 of the liner hanger 20 and the exterior surface 38 of the tubular 30.

In some embodiments, such as shown in FIG. 2, the interior surface 44 of the liner hanger 20 further includes a securement area 40 having an uneven inner diameter across a longitudinal length (with respect to longitudinal axis 42) of the securement area 40. As shown in FIG. 2, the liner hanger 20 exteriorly of the securement area 40 has an inner diameter D1, while the securement area 40 has at least two or more different inner diameters, such as, but not limited to, an inner diameter D2 that is greater than the inner diameter D1, and an inner diameter D3 which is smaller than the inner diameter D2 and which may be the same as or different than the inner diameter D1. As illustrated, the securement area 40 includes a plurality of alternating larger and smaller inner diameters D2, D3. Further, the securement area 40 may be otherwise grooved, ribbed, or roughed with alternating larger and smaller inner diameters. The securement area 40 may also include interior threads to form the variable diameter surface. The securement area 40 is configured to enhance the connection between the liner hanger 20 and the expandable member 36, and may vary depending on the material employed for the expandable member 36. As shown in FIG. 5, the exterior surface 38 of the tubular 30 may also include a securement area 56 to enhance the connection between the expandable member 36 and the tubular 30. Furthermore, the liner hanger assembly 18 may include both the securement area 56 as shown in FIG. 5 and the securement area 40 as shown in FIG. 2.

The material of the expandable member 36 is selected based on the expected conditions in which the liner hanger assembly 18 is to be deployed, and the weight of the liner hanger 20 including liner string 24. That is, the expandable member 36 is selected so that the running tool 28 can carry the weight of the liner hanger 20 and liner string 24 using the expandable member 36. In addition to providing a connection between the running tool 28 and the liner hanger 20, the expandable member 36 can further effectively seal the annulus 50 therebetween. In one embodiment, the expandable member 36 includes a swellable material, such as, but not limited to, a swellable elastomer, an elastomeric material such as rubber, for example, swelling EPDM, swelling Nitrile, etc. The swellable material may be reactive to various activator fluids including, but not limited to, oil and water. If the expandable member 36 includes an oil-reactive swellable material, then the expandable member 36 will be exposed to activator fluid 46 at least partially containing oil to connect the running tool 28 to the liner hanger 20 before running the liner hanger assembly 18 downhole. Likewise, if the expandable member 36 includes a water-reactive swellable material, then the expandable member 36 will be exposed to the activator fluid 46 at least partially containing water to connect the running tool 28 to the liner hanger 20 before running the liner hanger assembly 18 downhole.

Embodiments of the swellable material provide excellent swelling volumes when exposed to the activator fluid 46 having oil, water, or a combination comprising at least one of the foregoing. An oil swellable material for the expandable member 36 may contain an elastomer such as ethylene propylene diene monomer (EPDM), acrylonitrile butadiene rubber (NBR), synthetic rubbers based on polychloroprene (NEOPRENE™ polymers from DuPont), fluorinated polymer rubbers (e.g. FKM), perfluorocarbon rubber (FFKM), tetrafluoro ethylene propylene rubbers (FEPM, such as AFLAS™ fluoroelastomers available from Asahi Glass Co. Ltd.), fluorosilicone rubber (FVMR), butyl rubbers (IIR), and the like.

A water swellable material for the expandable member 36 may include the elastomer as described herein such as NBR and a super absorbent material. NBR can be crosslinked. The crosslinks are a product of crosslinking the polymer by sulfur, peroxide, urethane, metallic oxides, acetoxysilane, and the like. In particular, a sulfur or peroxide crosslinker is used.

While activator fluids 46 that are also found in a downhole environment, such as water and oil, have been disclosed for use in swelling the swellable material of the expandable member 36, the activator fluid 46 is not required to be one that is also found in the downhole environment since the expandable member 36 is expanded at surface. Further, additives such as fillers, activators, antioxidants, processing acids, and curatives can be included in the material of the expandable member 36. While swellable materials have been disclosed, the expandable member 36 may include alternate materials to connect the running tool 28 to the liner hanger 20, including, but not limited to, other swellable materials not specifically listed herein, shape memory materials, expandable foam, and inflatable materials.

Figure 10:
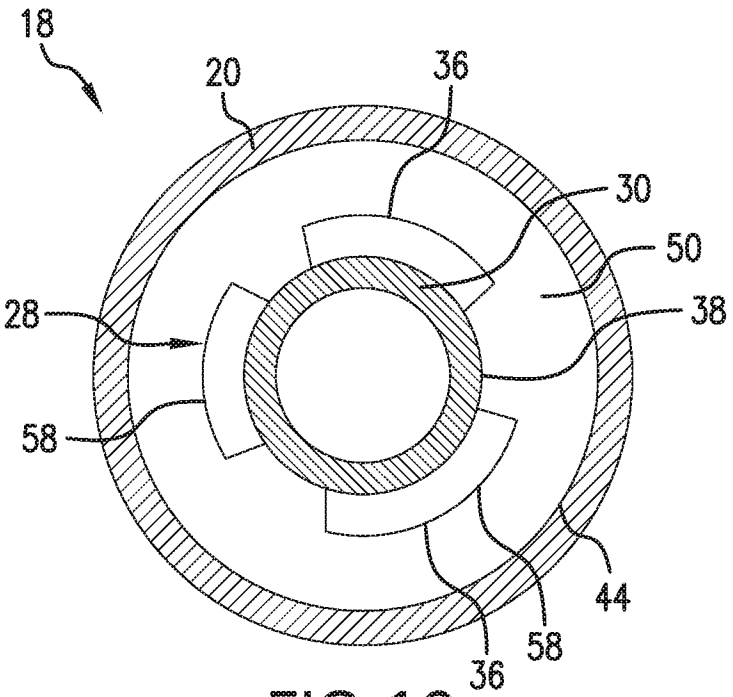
FIG. 10 depicts a schematic cross-sectional view taken along line 10-10 of the portion of the liner hanger assembly of FIG. 2.
Figure 9:
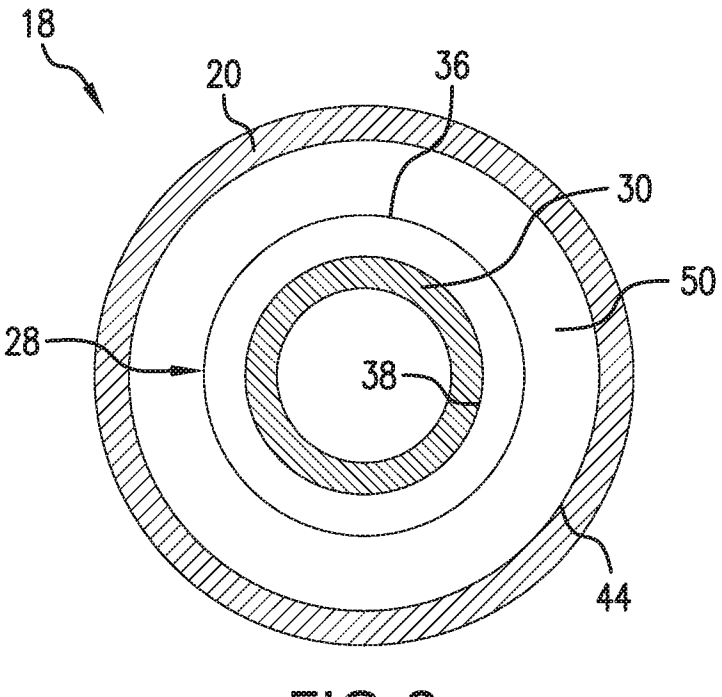
FIG. 9 depicts a schematic cross-sectional view taken along line 9-9 of the portion of the liner hanger assembly of FIG. 2.

Turning now to FIGS. 9 and 10, alternate embodiments of a cross-section of the expandable member 36, taken along lines 9-9 and 10-10 respectively from FIG. 2, are shown. In FIG. 9, the expandable member 36 is schematically depicted as having an uninterrupted circular cross-section. While depicted as disposed entirely circumferentially on the exterior surface 38 of the tubular 30, the expandable member 36 may have substantially the same uninterrupted cross-section when disposed on the interior surface 44 of the liner hanger 20. In FIG. 10, the expandable member 36 may be provided as a plurality of circumferentially distributed and separated segments 58. While depicted as arranged at discrete circumferential locations on the exterior surface 38 of the tubular 30, the expandable member 36 may have substantially the same circumferentially distributed segments 58 when disposed on the interior surface 44 of the liner hanger 20. Depending on the material selected for the expandable member 36, certain embodiments of the material may exhibit greater expansion from the first condition to the second condition when provided with greater exposed surface area in the first condition for providing increased contact with the activator fluid 46. Thus, providing a segmented expandable member 36, in either one or more of the circumferential direction as shown in FIG. 10, the radial direction as shown in FIGS. 6 and 7, and the longitudinal direction as shown in FIGS. 6 and 8 increases the surface area of the expandable member 36 for contacting the activator fluid 46 and may provide improved or speedier expansion.

Figure 13:
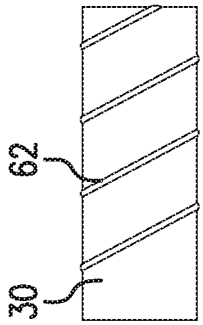
Figure 12:
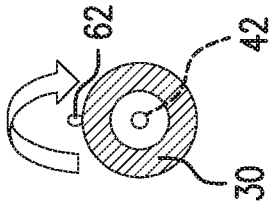
FIG. 12 depicts a schematic cross-sectional view of the release mechanism on the running tool of FIG. 11; and, FIG. 13 depicts a schematic side view of the release mechanism on the running tool of FIG. 11.
Figure 11:
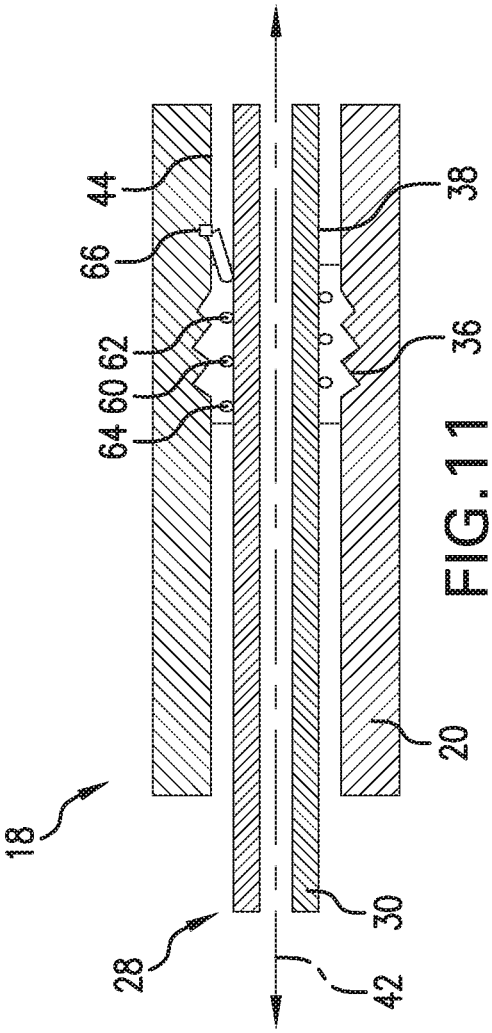
FIG. 11 depicts a schematic side sectional view of an embodiment of a release mechanism for the liner hanger assembly of FIG. 1.

In some embodiments, the expandable member 36 is the only component that connects the tubular 30 to the liner hanger 20. With reference now to FIGS. 11-13, in some embodiments, the liner hanger assembly 18 further includes a release mechanism 60 configured to facilitate release of the seal/carrying capacity of the expandable member 36 when removal of the running tool 28 from the liner hanger 20 is desired. The release mechanism 60 may be a feature of the running tool 28 and/or the liner hanger 20. In the illustrated embodiment of the release mechanism 60, a wire 62 includes a first end 64 attached to the tubular 30, such as the exterior surface 38 of the tubular 30, and a second end 66 attached to the liner hanger 20, such as the interior surface 44 of the liner hanger 20. In embodiments including such a release mechanism 60, the wire 62 and the expandable member 36 can be the only components that connect the tubular 30 to the liner hanger 20, however the wire 62 is not configured to carry the weight of the liner hanger 20 and liner string 24. The wire 62 may be helically wound around the tubular 30 as shown. Further, the wire 62 may be radially disposed between the tubular 30 and the expandable member 36. In an embodiment of assembling the liner hanger assembly 18 having the illustrated release mechanism 60, the wire 62 may be attached at its first end 64 to the tubular 30 and wrapped about the tubular 30. The expandable member 36 is then applied to the tubular 30 in the first condition (such as shown in FIG. 2) so that the expandable member 36 overlaps the wire 62 on the tubular 30, but does not overlap the second end 66 of the wire 62. The exposed second end 66 of the wire 62 is attached to the liner hanger 20, either before or after the expandable member 36 is expanded to the second condition. After the liner hanger 20 is set within an outer tubular, such as casing 16 (FIG. 1), in order to release the expandable member 36, the tubular 30 is rotated about the longitudinal axis 42 and with respect to the liner hanger 20 so that the wire 62 cuts through the material of the expandable member 36 and breaks the seal between the running tool 28 and the liner hanger 20. Once the expandable member 36 is released due to rotation, movement of the tubular 30 in the uphole direction 34 may shear the second end 66 from the liner hanger 20 to remove the running tool 28 from the borehole 12. In the embodiment having the wrapped wire 62, while running the liner hanger assembly 18, rotation of the running tool 28 with respect to the liner hanger 20 would not be permissible until the liner hanger 20 is set, because rotation would release the running tool 28 from the liner hanger 20. Thus, this embodiment would not be applicable in operations where such a rotation prior to setting might be required. However, this embodiment would be appropriate for operations where rotation is not necessary during run-in and setting. While a particular release mechanism has been described, alternate release mechanisms may further be included within the liner hanger assembly 18.

The running tool 28 is configured to carry the weight of the liner hanger 20 and liner string 24 into the borehole 12, as well as to provide a seal. The maximum weight that can be carried by the running tool 28 may, in some embodiments, be adjusted by increasing an amount of material in the expandable member 36 between the running tool 28 and the liner hanger 20. Such an adjustment could not be made in conventional running tools. Also, due to their expense and complexity, conventional running tools are typically owned and maintained by a service company, and rented to the customer, and the running tool is used over and over again. However, sometimes having rental tools that need to be redressed every time is inconvenient, and can be a limiting factor. The running tool 28, however, does not have a lot of moving parts and pieces as in conventional running tools.

Set forth below are some embodiments of the foregoing disclosure:

Embodiment 1

A downhole system having a liner hanger assembly includes a liner hanger and a running tool. The running tool includes a tubular and an expandable member disposed circumferentially around the tubular. The expandable member is configured to increase in volume from a first condition to a second condition at a surface location. The second condition of the expandable member connects the running tool to the liner hanger.

Embodiment 2

The downhole system as in any prior embodiment or combination of embodiments, wherein the expandable member includes a swellable material.

Embodiment 3

The downhole system as in any prior embodiment or combination of embodiments, wherein an outer diameter of the expandable member in the second condition is greater than an outer diameter of the expandable member in the first condition.

Embodiment 4

The downhole system as in any prior embodiment or combination of embodiments, wherein at least one of an interior surface of the liner hanger and an exterior surface of the tubular includes a securement area having first and second diameters, the first diameter greater than the second diameter, the expandable member in the second condition engaged with the securement area.

Embodiment 5

The downhole system as in any prior embodiment or combination of embodiments, wherein an exterior surface of the liner hanger includes a setting device configured to secure the liner hanger within an outer casing or borehole.

Embodiment 6

The downhole system as in any prior embodiment or combination of embodiments, further comprising a liner string connected to a downhole end of the liner hanger.

Embodiment 7

The downhole system as in any prior embodiment or combination of embodiments, further comprising a release mechanism disposed between the liner hanger and the tubular, the release mechanism configured to selectively break a seal between the running tool and the liner hanger when the expandable member is in the second condition.

Embodiment 8

The downhole system as in any prior embodiment or combination of embodiments, wherein the release mechanism includes a wire having a first end connected to the tubular and a second end connected to the liner hanger.

Embodiment 9

The downhole system as in any prior embodiment or combination of embodiments, wherein the wire is helically wrapped around the tubular, and the wire is configured to break through the expandable member upon rotation of the tubular with respect to the liner hanger.

Embodiment 10

The downhole system as in any prior embodiment or combination of embodiments, wherein the expandable member is disposed in the first condition on an exterior surface of the tubular and/or on an interior surface of the liner hanger, and the tubular is longitudinally movable with respect to the liner hanger in the first condition of the expandable member, and the tubular is longitudinally fixed with respect to the liner hanger in the second condition of the expandable member.

Embodiment 11

A method of assembling a liner hanger assembly, the method including: disposing an expandable member in a first condition circumferentially around a tubular; arranging the tubular and expandable member within a liner hanger at a surface location; and, expanding the expandable member to have a second condition and to connect the tubular to the liner hanger at the surface location.

Embodiment 12

The method as in any prior embodiment or combination of embodiments, wherein expanding the expandable member at the surface location includes introducing an activator fluid within an annulus between the liner hanger and the tubular.

Embodiment 13

The method as in any prior embodiment or combination of embodiments, wherein introducing the activator fluid includes placing the liner hanger and the tubular and expandable member within a tub of the activator fluid.

Embodiment 14

The method as in any prior embodiment or combination of embodiments, further comprising connecting a liner string to a downhole end of the liner hanger after expanding the expandable member.

Embodiment 15

The method as in any prior embodiment or combination of embodiments, further comprising, before disposing the expandable member around the tubular, attaching a release mechanism to the tubular and the liner hanger, and wherein disposing the expandable member around the tubular includes at least partially trapping the release mechanism between the tubular and the expandable member.

Embodiment 16

The method as in any prior embodiment or combination of embodiments, wherein the release mechanism includes a wire helically wrapped around the tubular.

Embodiment 17

A method of operating a liner hanger assembly having a running tool and a liner hanger, the method including: running the liner hanger downhole using the running tool, the running tool connected to the linger hanger by an expandable member, the expandable member having an increase in volume from a first condition to a second condition at a surface location prior to running the liner hanger downhole; and, setting the liner hanger within an outer tubular at a downhole location; wherein the running tool is configured to carry a weight of the liner hanger using the expandable member during run-in.

Embodiment 18

The method as in any prior embodiment or combination of embodiments, wherein the expandable member includes a swellable material exposed to an activator fluid at the surface location.

Embodiment 19

The method as in any prior embodiment or combination of embodiments, further comprising, after setting the liner hanger, breaking a seal created by the expandable member between the tubular and liner hanger using a release mechanism.

Embodiment 20

The method as in any prior embodiment or combination of embodiments, wherein the release mechanism is attached to the tubular and the liner hanger, and using the release mechanism includes rotating the running tool with respect to the liner hanger.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole system having a liner hanger assembly comprising:

a liner hanger having an inner surface defining a passage;

a running tool extending into the passage, the running tool including a tubular having an outer surface and an expandable member disposed circumferentially around the tubular and supported on at least one of the inner surface and the outer surface, the other of the inner surface and the outer surface including a securement area having a variable diameter section including multiple adjacent distinct diameter portions, the expandable member configured to increase in volume from a first condition to a second condition at a surface location and connect with the securement area, wherein the second condition of the expandable member connects the running tool to the liner hanger; and a release mechanism disposed between the liner hanger and the tubular, the release mechanism including a wire helically wrapped about the tubular, the wire having a first end connected to the tubular and a second end connected to the liner hanger, the release mechanism being configured to selectively break a seal between the running tool and the liner hanger when the expandable member is in the second condition wherein the wire is configured to break through the expandable member upon rotation of the tubular with respect to the liner hanger.

2. The downhole system of claim 1, wherein the expandable member includes a swellable material.

3. The downhole system of claim 1, wherein an outer diameter of the expandable member in the second condition is greater than an outer diameter of the expandable member in the first condition.

4. The downhole system of claim 1, wherein the securement area includes first and second diameters, the first diameter greater than the second diameter, the expandable member in the second condition extends into the first diameter locking the liner hanger to the tubular.

5. The downhole system of claim 1, further comprising a liner string connected to a downhole end of the liner hanger.

6. The downhole system of claim 1, wherein the expandable member is disposed in the first condition on an exterior surface of the tubular and/or on an interior surface of the liner hanger, and the tubular is longitudinally movable with respect to the liner hanger in the first condition of the expandable member, and the tubular is longitudinally fixed with respect to the liner hanger in the second condition of the expandable member.

7. The downhole system according to claim 1, wherein the expandable member includes a first expandable member provided on the inner surface of the liner hanger and a second expandable member provided on the outer surface of the tubular, the first expandable member and the second expandable being configured to increase in volume in the second condition so as to engage with one another and form the securement area.

8. The downhole system according to claim 1, wherein the multiple distinct diameters define a sawtooth-shaped profile.

9. A method of assembling a liner hanger assembly, the method comprising:

disposing an expandable member in a first condition circumferentially around a tubular;

arranging the tubular and expandable member within a liner hanger at a surface location, the liner hanger including an inner surface having a securement area having a variable diameter section including multiple adjacent distinct diameter portions;

expanding the expandable member to have a second condition into the securement area and to connect the tubular to the liner hanger at the surface location; and attaching a release mechanism to the tubular and the liner hanger before disposing the expandable member around the tubular, the release mechanism including a wire helically wrapped about the tubular, wherein disposing the expandable member around the tubular includes at least partially trapping the wire between the tubular and the expandable member, the wire being configured to break through the expandable member upon rotation of the tubular with respect to the liner hanger.

10. The method of claim 9, wherein expanding the expandable member at the surface location includes introducing an activator fluid within an annulus between the liner hanger and the tubular.

11. The method of claim 10, wherein introducing the activator fluid includes placing the liner hanger and the expandable member within a tub of the activator fluid.

12. The method of claim 9, further comprising connecting a liner string to a downhole end of the liner hanger after expanding the expandable member.

13. The method of claim 9, wherein arranging the tubular and expandable member within a liner hanger at the surface location includes positioning the expandable member at a sawtooth-shaped profile defining the securement area.

14. A method of operating a liner hanger assembly having a running tool and a liner hanger, the method comprising:

running the liner hanger having an inner surface downhole using the running tool having an outer surface, the running tool connected to the linger hanger by an expandable member through an interaction with a securement area having a variable diameter section including multiple adjacent distinct diameter portions, the expandable member having an increase in volume from a first condition to a second condition at a surface location prior to running the liner hanger downhole; and, setting the liner hanger within an outer tubular at a downhole location;

wherein the running tool is configured to carry a weight of the liner hanger using the expandable member during run-in; and after setting the liner hanger, rotating the running tool relative to the liner hanger to break a seal created by the expandable member using a release mechanism including a wire helically wrapped about the running tool, the wire breaking through the expandable member to break the seal.

15. The method of claim 14, wherein the expandable member includes a swellable material exposed to an activator fluid at the surface location, the swellable material extending into the securement area.

16. The method of claim 14, wherein the running tool is connected to the linger hanger by an expandable member through an interaction with a sawtooth-shaped profiled defining the securement area.

* * * * *